US008240376B2

(12) United States Patent
Gordon et al.

(10) Patent No.: US 8,240,376 B2
(45) Date of Patent: Aug. 14, 2012

(54) PRESSURE EQUALISING DEVICES

(75) Inventors: Stuart Gordon, Aberdeen (GB); Irvine Cardno Brown, Aberdeen (GB); Michael Adam Reid, Aberdeen (GB)

(73) Assignee: Red Spider Technology Limited, Aberdeen (GB)

( * ) Notice: Subject to any disclaimer, the term of this patent is extended or adjusted under 35 U.S.C. 154(b) by 0 days.

(21) Appl. No.: 13/098,609

(22) Filed: May 2, 2011

(65) Prior Publication Data

US 2011/0203789 A1 Aug. 25, 2011

Related U.S. Application Data

(63) Continuation of application No. 12/083,580, filed as application No. PCT/GB2006/003990 on Oct. 26, 2006.

(30) Foreign Application Priority Data

Oct. 27, 2005 (GB) ..... 0521917.5

(51) Int. Cl.
*E21B 34/10* (2006.01)

(52) U.S. Cl. ..... 166/250.04; 166/66

(58) Field of Classification Search ..... 166/250.04, 166/373, 374, 386, 66
See application file for complete search history.

(56) References Cited

U.S. PATENT DOCUMENTS

| | | | |
|---|---|---|---|
| 3,577,782 | A | 5/1971 | Aitken |
| 3,800,277 | A | 3/1974 | Patton et al. |
| 4,796,699 | A | 1/1989 | Upchurch |
| 4,924,701 | A | 5/1990 | Delatorre |
| 5,355,960 | A | 10/1994 | Schultz et al. |
| 6,021,095 | A | 2/2000 | Tubel et al. |
| 6,125,930 | A | 10/2000 | Moyes |
| 6,666,275 | B2 | 12/2003 | Neal et al. |
| 6,776,240 | B2 | 8/2004 | Kenison et al. |
| 6,957,699 | B2 | 10/2005 | Feluch et al. |
| 2003/0196493 | A1 | 10/2003 | Mallison et al. |
| 2004/0226721 | A1 | 11/2004 | Feluch et al. |
| 2007/0125554 | A1 | 6/2007 | Reid |

FOREIGN PATENT DOCUMENTS

| | | | |
|---|---|---|---|
| EP | 0237662 | A1 | 9/1987 |
| EP | 0566382 | A1 | 10/1993 |
| GB | 1547816 | A | 6/1979 |
| GB | 2280013 | A | 1/1995 |
| GB | 2314863 | | 1/1998 |
| GB | 2339226 | A | 1/2000 |

(Continued)

OTHER PUBLICATIONS

PCT-GB2006/003990—Search Report, Mar. 22, 2007, Red Spider Technology Limited.
PCT-GB2006-003990—Preliminary Report on Patentability, Apr. 29, 2008, Red Spider Technology Limited.

(Continued)

*Primary Examiner* — William P Neuder
(74) *Attorney, Agent, or Firm* — Edwards Wildman Palmer LLP; David J. Silvia

(57) ABSTRACT

An electronic actuation system for a pressure equalizing device in a downhole apparatus such as a wellbore plug is described. The system includes a pressure sensor for measuring pressure in the wellbore, and means for setting a reference pressure value using a measurement from the pressure sensor. In a method of use, an applied pressure value is determined using a measurement from the pressure sensor and the reference pressure value, and the device is actuated, or opened, when the applied pressure meets a pre-determined condition, such as falling within a pressure window for certain time period. The invention allows natural changes in wellbore pressure to be accounted for when detecting a pressure actuation event.

9 Claims, 5 Drawing Sheets

FOREIGN PATENT DOCUMENTS

| | | | |
|---|---|---|---|
| GB | 2411677 | A | 9/2005 |
| GB | 2431943 | A | 5/2007 |
| WO | WO-9011429 | A2 | 10/1990 |
| WO | WO-9013731 | A2 | 11/1990 |
| WO | WO-0118357 | A2 | 3/2001 |
| WO | WO-2005052302 | A2 | 6/2005 |

OTHER PUBLICATIONS

G. Elliott; G.D. Makin; S.E. Ferguson, P.B. Moyes; "Intervention-Free Completion Suspension and Installation West of Shetland," May 1999, pp. 1-10; © 1999, Offshore Technology Conference.

"Omega Addressable Completion Accessory Tool," © 1998; Omega Completion Technology Ltd., United Kingdom, 2 pages.

PRESSURE EQUALISING DEVICES

CROSS REFERENCE TO RELATED APPLICATIONS

This application is a continuation of U.S. patent application Ser. No. 12/083,580, filed on Apr. 15, 2008 as a U.S. national phase application, pursuant to 35 U.S.C. §371, of International Application No. PCT/GB2006/003990, published in English on May 3, 2007 as International Publication No. WO 2007/049046 A1, which claims the benefit of British Application Ser. No. GB 0521917.5, filed Oct. 27, 2005. The content of each of the above-mentioned applications are incorporated by reference herein.

BACKGROUND OF THE INVENTION

1. Field of the Invention

The present invention relates to pressure equalising devices used in oil and gas wells and in particular to improved actuation methods and apparatus for pressure equalising devices. In one of its aspects the invention relates to an improved wellbore plug.

2. Description of Related Art

During the lifetime of an oil/gas production well, various servicing operations will be carried out to the well to ensure that the efficiency and integrity of the well is maximised. These include a full work over, a surface wellhead tree change, side tracking or close proximity drilling operations. To allow any of these operations to be done safely and to accommodate verification pressure tests from surface, it is necessary to install a plug (or plugs) into the production tubing to create a barrier to test against and provide isolation from the production zones.

These plugs are typically run into or retrieved from the wellbore on wireline or tubing strings. When retrieving plugs it is necessary to equalise pressure above and below prior to unlocking and removal. This often involves an extra intervention run to initiate pressure equalisation prior to retrieval.

Various types of pressure equalising devices have been developed for use with plugs, including those known as "pump open plugs" and a "pressure cycle plugs". Recently, there has been proposed a pressure equalising device with a controlled timed release actuation, as disclosed in WO 2005/052302. This device is configured to open the plug such that there is fluid communication through the plug to the upper and lower portions of the wellbore, in response to an applied and maintained pressure within a predetermined pressure range (or "opening window") for a certain period of time. If this condition is not satisfied, the device is not actuated. This enables a range of different pressure tests to be performed in the wellbore, for example at pressures outside of the predetermined range and/or at pressures within the opening window but over a time period shorter than that required for opening.

This plug operates on the principle that pressure testing events do not occur for long durations at pressures within the predetermined pressure zone. Conversely, an actuating pressure event for opening the plug must be identified as being in the predetermined zone for a sufficient period of time within a defined pressure zone.

One particular problem associated with the prior art devices is that they operate on the principle of applied differential pressures, requiring knowledge of the pressure in the wellbore. That is, the pressure applied at surface must correspond to the pressure suitable for actuating the equalising device. In many wells it is common for changes in the well and formation environment to affect the pressure of fluid in the wellbore. Thus, it might be necessary to adjust the applied pressure to account for any variation in the ambient wellbore pressure. These pressure variations can prevent a user from knowing what applied pressure is adequate to satisfy the conditions necessary for opening the plug.

In addition, gradual increases in wellbore pressure due to environmental conditions might also lead to the wellbore pressure falling within the predetermined zone for a period of time such that there is a risk of unintentional actuation of the equalising device.

SUMMARY OF THE INVENTION

It is an aim of the present invention to provide methods and apparatus that obviate or at least mitigate some of the drawbacks of prior art devices.

According to a first aspect of the present invention, there is provided a method of controlling actuation of a pressure equalising device in a downhole tool, the method comprising the steps of:

- Using a measurement from a pressure sensor provided in the downhole tool to set a reference pressure value;
- Determining an applied pressure value using a measurement from the pressure sensor and the reference pressure value;
- Actuating the device when the applied pressure meets a pre-determined condition.

Preferably, the downhole tool is a wellbore plug.

Preferably, the method includes the steps of measuring pressure values at a plurality of sampling intervals and recording the pressure values.

Preferably, the method includes the additional step of detecting a pressure change event in the wellbore using the pressure sensor. More preferably, the method includes the step of calculating a rate of pressure change and comparing the rate of pressure change with a pre-determined threshold.

By comparing the rate of pressure change with a threshold value, the method determines whether a variation in pressure is due to a "natural" change in the wellbore environment, or an effected change due to a pressure applied at the surface. This could be a high pressure test, a low pressure test, or a pressure event to actuate the pressure equalising device.

Preferably, the reference pressure value is selected from the plurality of measured pressure values. The reference pressure value may be selected as the lowest pressure value measured during a preceding time interval.

Preferably, the pre-determined condition is that the applied pressure falls within a predetermined range for a specified time period.

According to a second aspect of the present invention, there is provided a method of equalising pressure across a wellbore plug, the method comprising the steps of:

- Using a measurement from a pressure sensor provided in the wellbore plug to set a reference pressure value;
- Increasing pressure from the surface of a wellbore by an amount within a predetermined pressure range;
- Calculating an applied pressure value using measurement from the pressure sensor and the reference pressure value;
- Actuating a pressure equalising mechanism in the wellbore plug when the calculated applied pressure falls within the predetermined range for a specified time period.

In this way, the reference point is used as a reference for the conditions at which the pressure equalising mechanism actuates. When the pressure at the surface of the wellbore is increased by a specified amount (falling within the "opening window") the calculated applied pressure will correspond to the pressure applied at surface. In other words, the pressure applied at surface does not need to be adjusted to take account of variations in wellbore pressure downhole.

Preferably, the method includes the steps of measuring pressure values at a plurality of sampling intervals and recording the pressure values.

Preferably, the method includes the additional step of detecting a pressure change event in the wellbore using the pressure sensor. More preferably, the method includes the step of calculating a rate of pressure change and comparing the rate of pressure change with a pre-determined threshold.

By comparing the rate of pressure change with a threshold value, the method determines whether a variation in pressure is due to a "natural" change in the wellbore environment, or an effected change due to a pressure applied at the surface. This could be a high pressure test, a low pressure test, or a pressure event to actuate the pressure equalising device.

Preferably, the reference pressure value is selected from the plurality of measured pressure values. The reference pressure value may be selected as the lowest pressure value measured during a preceding time interval.

Preferably, the pre-determined condition is that the applied pressure falls within a predetermined range for a specified time period.

According to a third aspect of the invention there is provided a wellbore plug comprising:

a body for locating on a work string;

a bore provided through a portion of the body;

one or more ports provided in the body for passage of fluid between regions of the wellbore above and below the plug;

an actuating member moveable relative to the body from a first position in which the ports are covered to a second position in which the ports are uncovered;

an electronic actuating system for controlling movement of the actuating member from the first to second position;

wherein the electronic actuating system includes a pressure sensor for measuring pressure above the plug, and means for setting a reference pressure value using a measurement from the pressure sensor.

Preferably, electronic actuating system further includes a processor module for setting the reference pressure value.

Preferably, the electronic actuating system further includes a second pressure sensor for measuring pressure below the plug.

Preferably, the electronic actuating system includes a memory unit for storing measured pressure values.

According to a fourth aspect of the invention, there is provided an electronic actuation system for a pressure equalising device in a wellbore plug, the system including a pressure sensor for measuring pressure above the plug, and means for setting a reference pressure value using a measurement from the pressure sensor.

Preferably, electronic actuating system further includes a processor module for setting the reference pressure value.

Preferably, the electronic actuating system further includes a second pressure sensor for measuring pressure below the plug.

Preferably, the electronic actuating system includes a memory unit for storing measured pressure values.

Preferably, the processor unit is programmed to compare the pressure gradient with the reference parameters.

Preferably, the system further includes a second pressure sensor for measuring pressure below the plug and relative to the zero reference pressure.

BRIEF DESCRIPTION OF THE DRAWINGS

There will now be described, by way of example only, various embodiments of the present invention with reference to the following drawings, of which.

DETAILED DESCRIPTION OF PREFERRED EMBODIMENTS

Figures 1A, 1B, 1C:
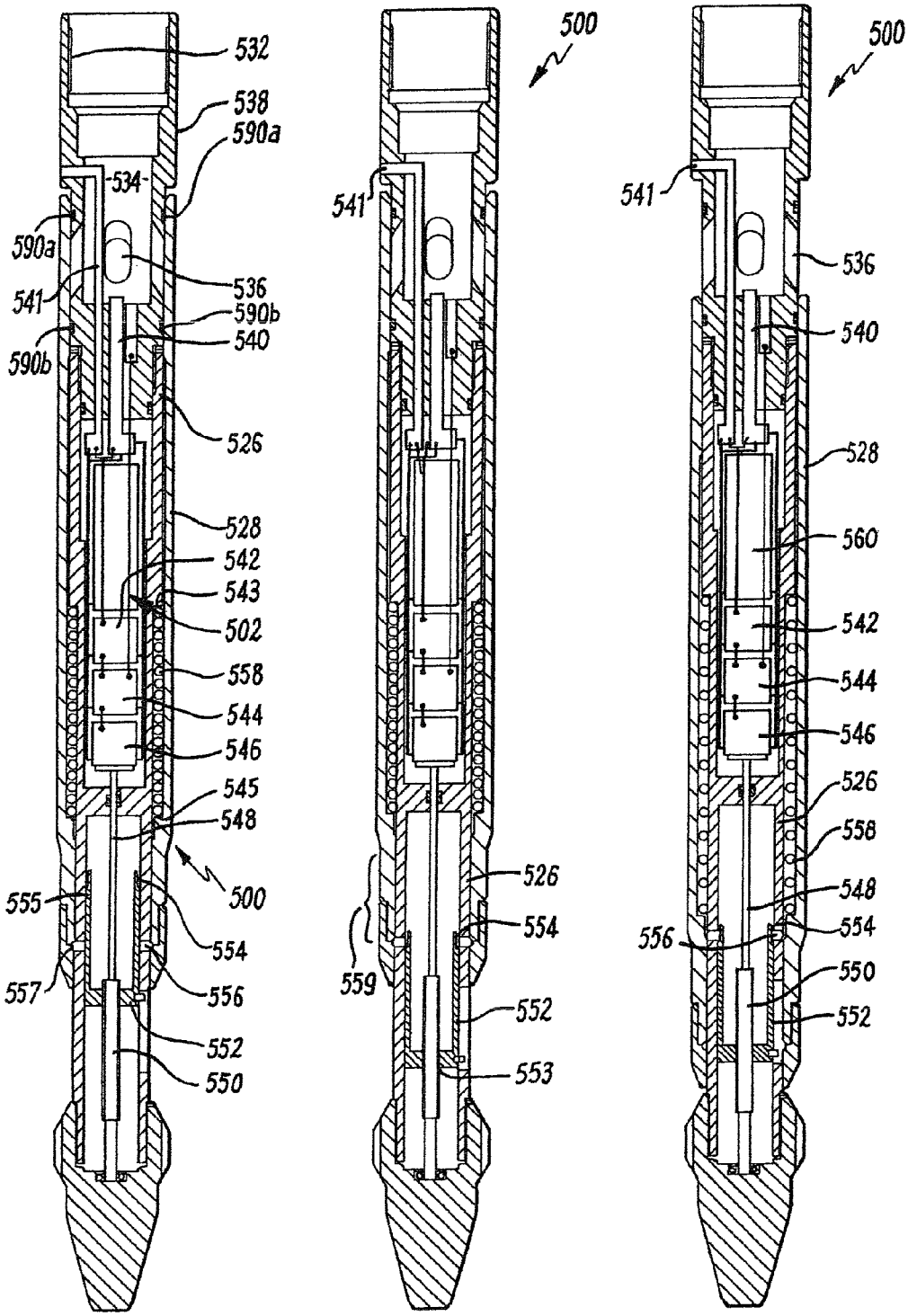
FIG. 1A is a cross-sectional representation of a pressure equalising device in a closed configuration according to an embodiment of the present invention.
FIG. 1B is a cross-sectional representation of the pressure equalising device of FIG. 1A just prior to opening.
FIG. 1C is a cross-sectional representation of the pressure equalising device of FIGS. 1A and 1B in an open configuration.

With reference firstly to FIGS. 1A to 1C there is generally depicted at 500 a pressure equalising device at different stages of operation. The device comprises a substantially cylindrical body assembly 526 on which is located an outer sleeve 528. At an upper end of the body 526 there is located a threaded connector 532 for joining the equalising device 500 to an anchoring device, such as a packer or other suitable device, located on a work string (not shown). The equalising device is "set" when it is sealed in the wellbore via the anchoring device to form a plug.

Body 526 comprises an upper bore portion 534 for continuance of the bore of the work string. This allows fluid communication via the bore of the work string to the equalising device. A first pressure sensor (S1) 540 is located within the body 526 and is adapted to sense pressure of wellbore fluid above the device, i.e. the fluid in the upper bore portion 534. There is also located a second pressure sensor (S2) 541 in the body 526 of the device, which can sense the pressure of the region below the plug through an outer surface 538 of the device.

Through the body 526 are arranged four circumferentially spaced radial flow ports 536. The ports 536 are opened or closed via movement of the outer sleeve 528. In the closed position, shown in FIG. 1A, the outer sleeve 528 covers the flow ports 536 and the sensors independently measure pressure values from the wellbore above and below the plug. In the open position, shown in FIG. 1C, there is fluid communication between the upper and lower portions of the wellbore and both sensors are exposed to the same volume, such that the pressure is equalised across the plug. It will be appreciated that the size of these ports 536 may be selected to determine a flow area for fluid from the outer surface 538 of the plug 500 to the bore portion 534 and thereon through the work string. Flow ports 536 are angled downwards to enhance the passage of fluid flow.

Seals 590*a*, 590*b* prevent any fluid flow between the ports 536 and the outer surface 538 when the sleeve 528 covers the ports 536. Outer sleeve 528 is biased to the open position by virtue of a compression spring 558 located between a shoulder 543 of the body 526 and a shoulder 545 on the sleeve 528.

The equalising device 500 includes an electronic actuating mechanism, shown generally at 502, which comprises a pressure transducer unit 542 connected to the sensors S1 and S2 for converting the pressures measured by the sensors into an electronic signal. The actuating system 502 further comprises a logic processor 544 programmed to perform logical operations and calculations relating to the measured signals. Motor 546 of the system 502 operates in response to signals of the logic processor 544 and is powered by a battery 560. In this embodiment, the motor 546 comprises a rotatable shaft 548 with a threaded ball screw 550. In an alternative embodiment, two motors are used in tandem. The ball screw 550 is adapted to engage with a mating thread 553 of a sleeve 552, which is movably located within the body 538. Rotation of the motor shaft causes rotation of the screw 550 within the thread 553 and in turn causes motion of the sleeve 552 relative to the body 538.

In FIG. 1A the sleeve 552 is located within the body 538 such that an outer surface of the sleeve 555 closely juxtaposes an inner surface of the body 538. This arrangement ensures that the sleeve 528 is held in the closed orientation with ports 536 covered by the sleeve 526, by biasing a key 556 radially outwards against a corresponding slot 557 of the sleeve 526.

In FIG. 1B, the sleeve 552 is displaced by a distance 559 (due to operation of the motor 546), such that the key 556 aligns with a recess 554 of the sleeve 552 providing sufficient space for the key 556 to retract and move radially inwards from the slot 557 of the sleeve, and such that the sleeve can move from the closed position under influence of the spring 558 to the open position as in FIG. 1C.

In the closed position and after sealing and anchoring in the wellbore between the production tubing inner diameter and the body 526, pressure can be applied to the device 500 by the flow of fluid downwards through the work string. This pressure may then be measured by the sensor S1 540 and is in turn converted to a signal via the electronic actuating system 502 for controlling the motor.

The equalising device actuates to provide pressure equalisation in response to pressure in the above-plug region staying within a particular pressure range for a set period of time. This method of actuation allows pressure tests (typically comprising rapidly increasing pressure to a certain level and then back down) to be carried out in the wellbore, as these events do not trigger opening of the plug, and does not rely on the below-plug pressure to operate.

In operation, pressure applied to fluid in the workstring and pressures from other sources is felt by the pressure sensor 540 of this equalising device, which is exposed to the pressure in the upper portion of the wellbore, above the plug. Via the pressure transducer 542, the applied pressure is transmitted to a logic processor 544. The logic processor 544 is programmed to hold a motor 546 in a fixed position, as in FIG. 1A, until the applied pressure is within the predetermined pressure range or plug opening window. When in the predetermined range for the required time, the logic processor 544 switches on the motor 546 to operate. With the motor on, shaft 548 is rotated and with it the ball screw 550 rotates. Sleeve 552, threaded upon the ball screw 550 is moved downwards relative to the body 26. If the pressure remains in the predetermined range for a given time period, the plug will open. The motor is only actuated if the pressure stays within the predetermined range for the required time; if at any time the pressure increases above or below the predetermined range, the motor will not be actuated.

Opening occurs as shown in FIG. 1C. In this position, the recess 554 on the surface of the sleeve 552 is located behind the key 546, on the body 526. The key 546 is drawn radially inwards thus releasing the outer sleeve 528 from the body 526. Spring 558, which had been held in compression between the sleeve 528 and the body 526, then expands. This forces the sleeve 528 downwards relative to the body 526 and the radial ports 536 are opened. The logic processor can also be programmed to reset the device 500 if desired. While the device 500 could be powered from the well surface, it is more convenient to use a battery pack 560 which can be located in the body 526.

Figure 2:
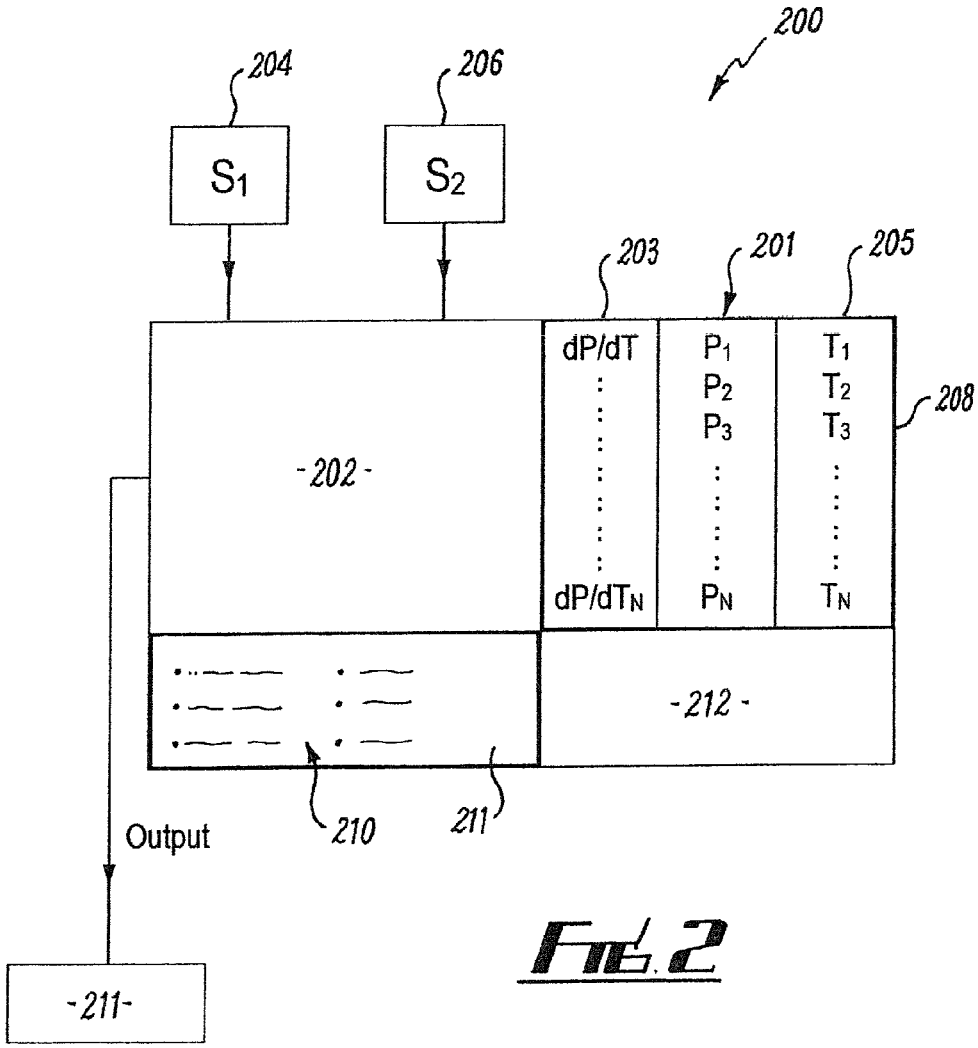
FIG. 2 is a schematic representation of an electronic actuation system for a pressure equalising device according to an embodiment of the present invention.

The electronic actuation system 502 distinguishes a pressure testing event from an actuating pressure for opening the plug. With reference to FIG. 2, there is depicted at 200 a system for identifying pressure events in a region of a wellbore above a plug, and for controlling actuation of the pressure equalising device as described above with reference to FIGS. 1A to 1C.

The system 200 comprises a logic processor 202 for "intelligently" recording pressure samples 201 and performing calculations of pressure gradient 203 with respect to time 205. The system also comprises a pressure sensor 204 (S1), which when the device is sealed in the wellbore, is exposed to the wellbore pressure above the plug and a second pressure sensor 206 (S2), which when the device is sealed in the wellbore, is exposed to the wellbore pressure below the plug. Before sealing or setting of the device in the wellbore, during run-in for example, both sensors 204 and 206 are exposed to the same wellbore pressure. After sealing they typically operate independently. Upon actuation, the equalising device equalises pressure across this plug such that both sensors are exposed to the same volume of fluid.

In this example, the sensor (S1) 204 measures pressure above the wellbore plug, controlled by the logic processor 202, at specified time intervals. Each pressure sample and corresponding clock time may be stored in a sample storage unit 208 of the logic processor 202.

A number of different parameters 210 are stored in a parameter storage unit 211 of the logic processor 202. These parameters include:

- upper and lower pressure ($P_U$ and $P_L$) values of the pressure range or "opening window" for actuation;
- a zero reference pressure (ZRP) value to serve as a reference value for pressure measurements;
- a reference pressure event gradient;
- a pressure threshold value ($P_{TH}$) for use in determining pressure test classes;

Further, the logic processor 202 includes a calculator unit 212 for performing various arithmetic operations and logic functions.

The logic processor 202 outputs a signal to a motor 211 according to the pressure samples received and the various calculations and logic operations performed by the processor 202. Correspondingly, the motor 211 operates as described with reference to FIGS. 1A to 1C to actuate the equalising device when certain conditions are met.

Figure 3:
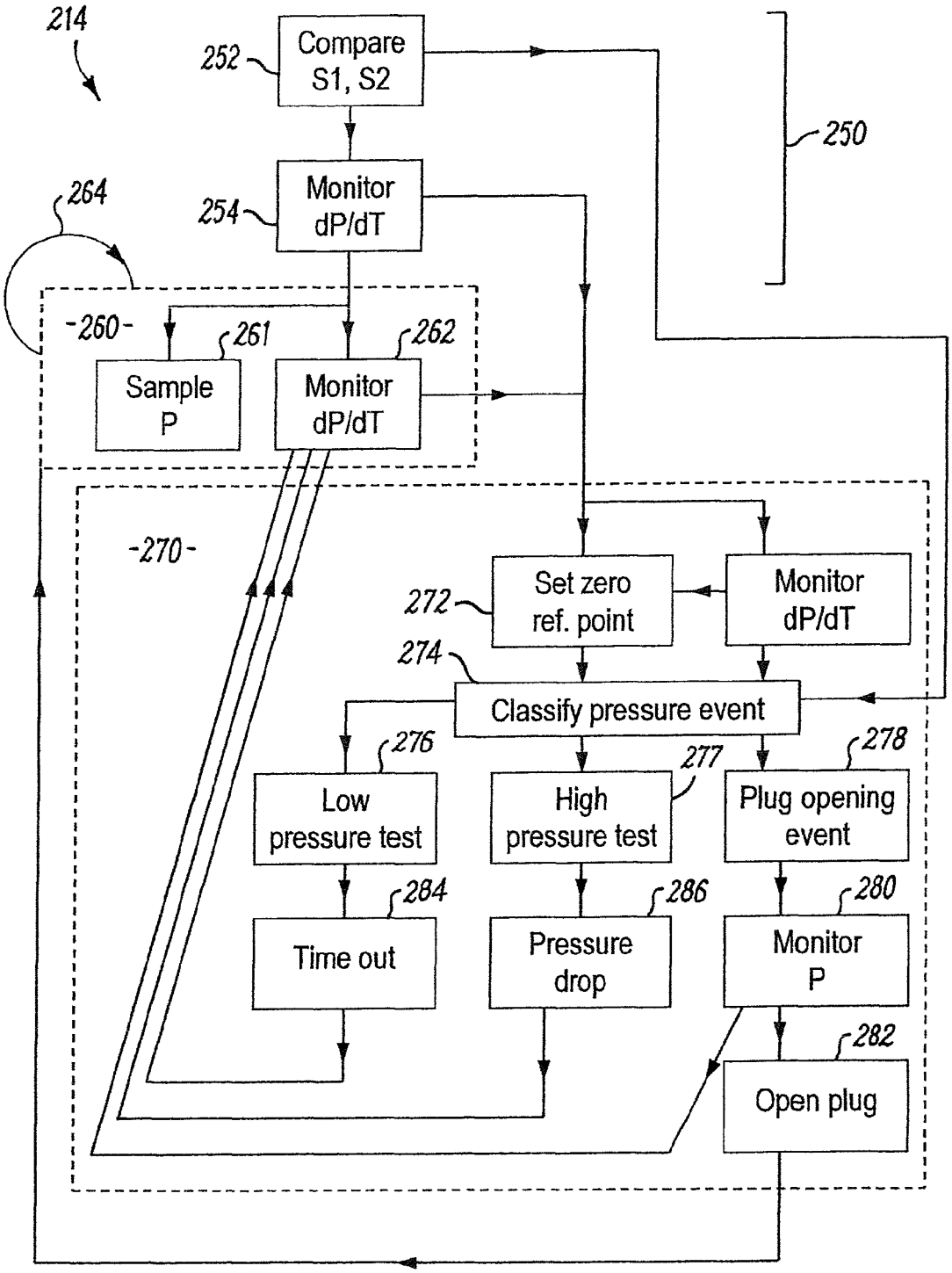
FIG. 3 is a flow chart representing the operation of a system in accordance with an embodiment of the invention.

With reference now to FIG. 3, there is depicted generally at 214 a flow chart representing the operational modes of a system according to an embodiment of the invention.

During run-in of the wellbore plug, the system is in a run-in or initialisation mode 250, during which pressure measurements from pressure sensors S1 and S2 are compared with one another (step 252). During run-in, the pressure experienced by S1 and S2 will be the same, but at some point after setting of the plug, a difference between the two pressure values will be detected, for example due to a pressure test, or a hydrostatic head above the plug. When the difference between the two readings reaches predetermined value, in this example 200 psi, the system knows that it has been set and will begin normal operation. However, it is also necessary for the system to determine whether or not a pressure test is underway. The system therefore monitors the rate of change of pressure (step 254) by comparing each new pressure sample with the previous one. If the rate of pressure change dP/dT exceeds a predetermined threshold, the system enters a pressure test mode, generally depicted at 270. If the rate of pressure change is less than the predetermined threshold, the system enters a zeroing mode, generally depicted at 260. In this example, the system recognises a pressure test event if the rate of change dP/dT exceeds 100 psi/min.

In the zeroing mode 260, the system continues to take new pressure samples (step 261) and compare each new pressure sample with previous samples, such that the rate of pressure change, dP/dT can be monitored (step 262). If the rate of pressure change is below the threshold for identifying a pressure test, the system remains in zeroing mode 260 and continues to sample and record pressure values, as indicated by the cyclical arrow 264. If however the rate of pressure change exceeds the predetermined threshold, the system prepares to enter pressure test mode 270.

Before pressure events can be effectively classified, it is necessary to set a reference point, or zero reference point (ZRP) (step 272), such that the applied pressure can be accurately determined.

The zero reference point is determined from the record of pressure measurement stored in the system. Typically, the zero reference point will be selected as the lowest pressure value measured during a fixed number of samples preceding the pressure test event. If the pressure test involves a gradual increase in pressure, it may be some time before the event is recognised as a pressure test. It may therefore be necessary for the system to take a zero reference point from several sampling intervals preceding the pressure test event.

When the zero reference point has been determined, it is used as a reference for subsequent pressure measurement, in order to calculate an applied pressure value. This value corresponds to the pressure applied at the surface of the wellbore. In this embodiment, the system monitors the rate of pressure change, and when the pressure stabilises (in other words the rate of change falls below the predetermined threshold for defining a pressure test), the system classifies (step 274) the type of pressure event into one of a number of categories 276, 277, 278. In this case, the system determines whether or not the pressure event is:

- a low pressure test 276 (when the applied pressure is less than the predetermined threshold, for example 500 psi);
- a high pressure test 277 (when the applied pressure exceeds a predetermined threshold, for example 1,000 psi), or;
- a plug opening or actuation event 278 (when the applied pressure falls within the predetermined opening window for the wellbore plug.

Each of these thresholds will be pre-programmed into the system, but their absolute values will be adjusted such that they are relative to the zero reference point selected.

If the pressure event is classified as a plug opening or actuating event, i.e. the applied pressure falls within the opening window, the system monitors the applied pressure (step 280) to see if the pressure remains in the opening window for the specified opening time. In this example the specified opening time is 10 minutes, if the pressure remains in the opening window for specified time, the plug will open (step 282). However, in this embodiment, the system also includes the provision that the plug will not open if the comparison of pressure values at S1 and S2 reveals that the pressure in the wellbore beneath the plug exceeds the pressure in the wellbore above the plug.

If the applied pressure value falls outside of the opening window before the opening time has expired, then the system waits until the pressure has dropped to a predetermined percentage, for example 25%, of the highest pressure value applied during the test, and the system enters into zeroing mode 260.

By setting a zero reference pressure, the applied pressure measured by the pressure sensor and used to actuate opening of the plug corresponds to the actual pressure increase applied at the surface. This reduces the likelihood of other pressure variations causing the opening window to be missed.

If the pressure event is classified as a low pressure test 276, i.e. an applied pressure lower than a predetermined value, for example 500 psi, the system goes into a timeout mode 284. Once the timeout period, which in this example is 30 minutes, has expired, the plug returns to zeroing mode 260.

If the pressure event is classified as high pressure test 278, i.e. an applied pressure higher than a predetermined value, for example 1,000 psi, the system waits until the pressure has dropped to, for example 25% of the highest pressure value in the test (step 286) before returning to zeroing mode 260.

It will be understood that the specific values quoted in these examples may be varied. Typically the values will be selected and programmed into the system during configuration.

Figure 4:
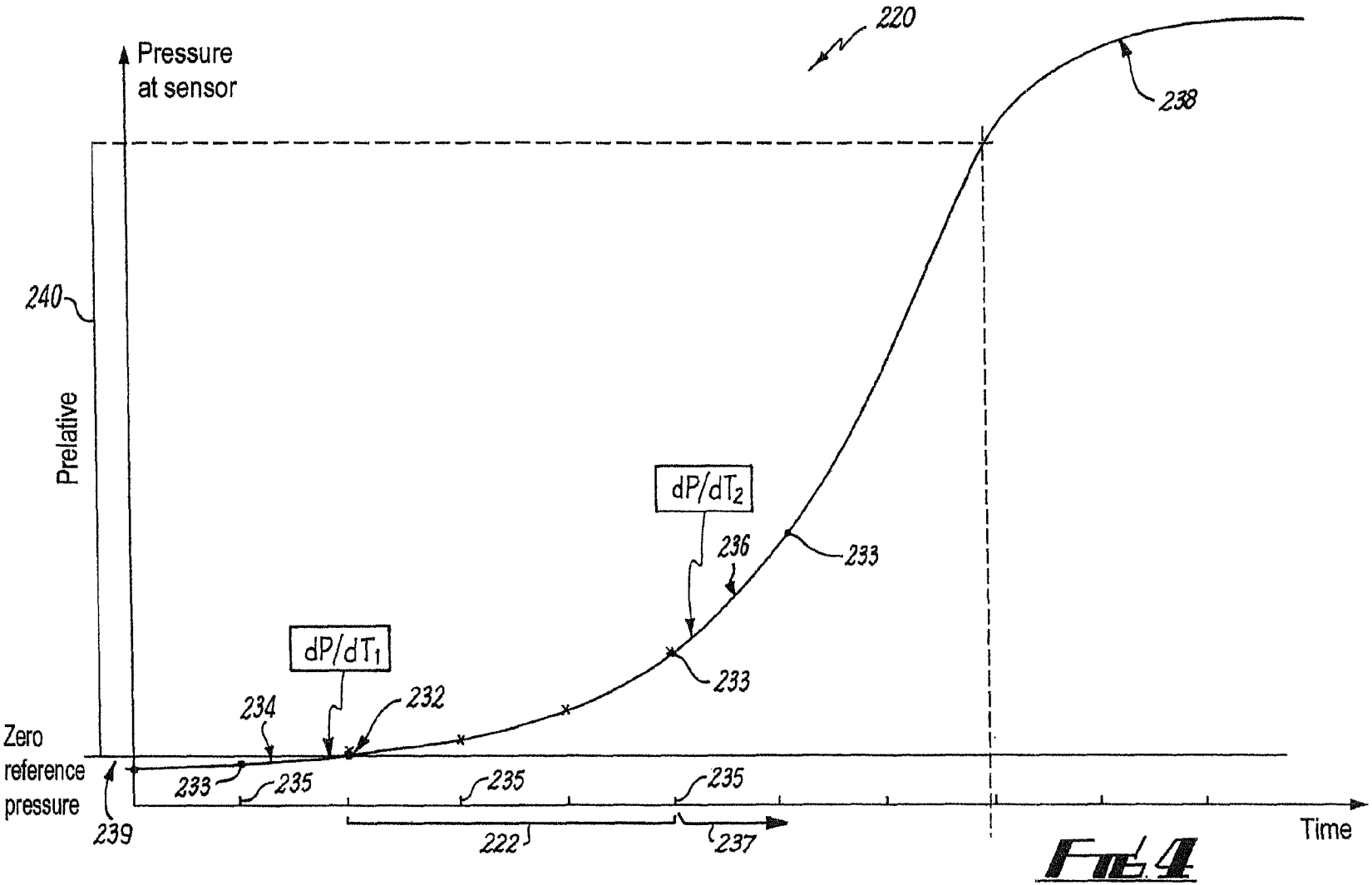
FIG. 4 is a graph of pressure above a wellbore plug versus time in accordance with an embodiment of the present invention.

FIG. 4 is a graph of pressure at the sensor S1 versus time for a specific example, generally depicted at 220. In FIG. 4, pressure samples 233 are measured at sampling times 235 and recorded by the system 200. As measurements are made, pressure change rates dP/dT at 234 and 236 are calculated.

In the example of FIG. 4, the pressure change rate dP/dT does not exceed the predetermined threshold at 234, and therefore the system is in the zeroing mode. At 236, the pressure change rate does exceed the predetermined threshold, and thus the system determines that a pressure event is occurring. The system thus prepares to enter pressure test mode, and must calculate a zero reference point (ZRP) value. In this case, the zero reference pressure (ZRP) 239 is determined as the lowest value of pressure 232 measured and stored by the system 202 over the time period 222.

The pressure values measured at times 237 subsequent to the detection of a pressure test and the ZRP value are used to calculate an applied pressure. The applied pressure thus accounts for pressure variations experienced at the sensor S1. This means that the pressure change experienced by the pressure sensor, which is used to determine whether the plug should be opened, will correspond to the actual pressure applied at the surface to open the plug.

Figure 5:
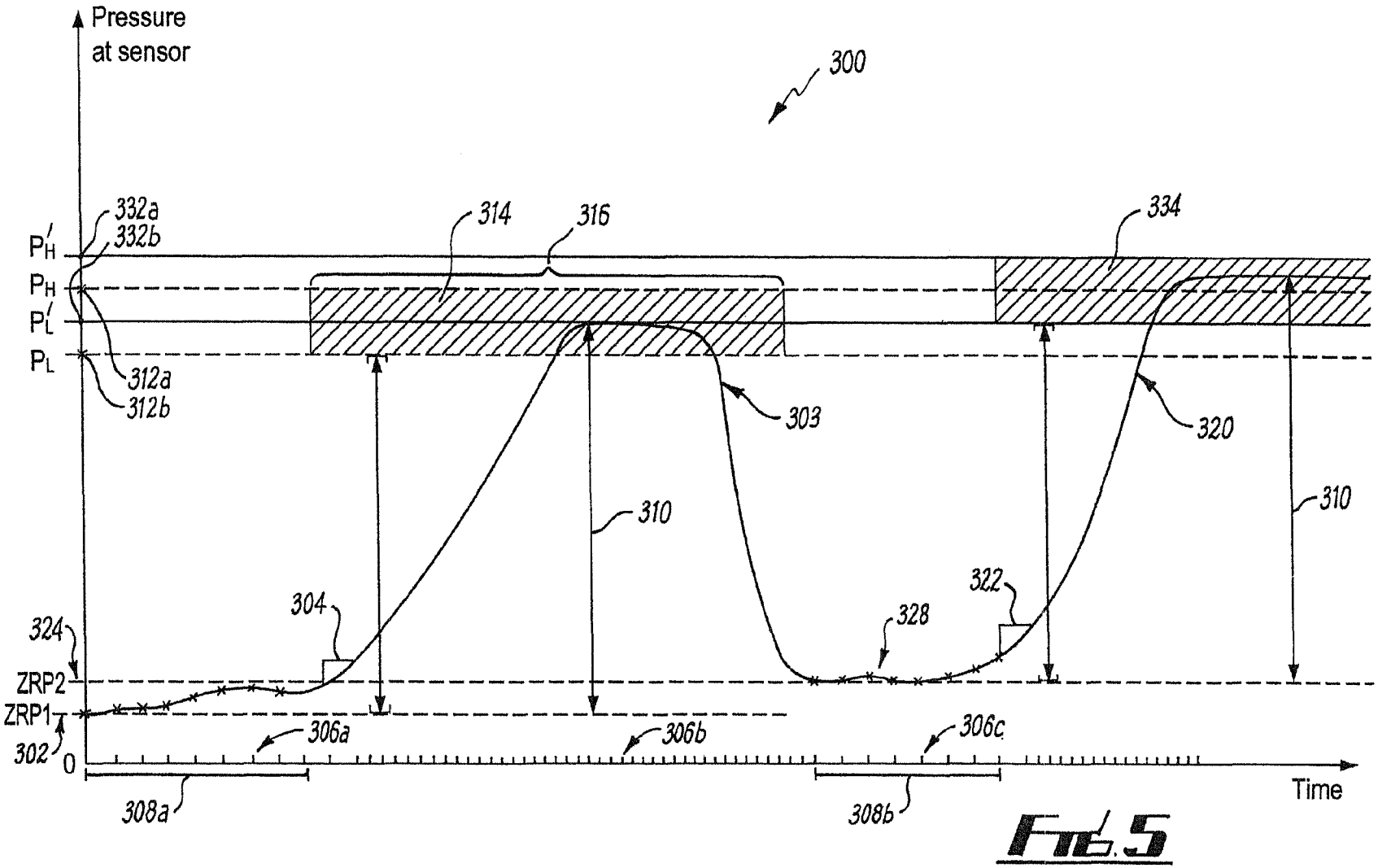
FIG. 5 is a graph of pressure above a wellbore plug versus time in accordance with a further embodiment of the present invention.

In FIG. 5 is a graphical representation, generally depicted at 300 of the pressure as experienced at the sensor S1. The pressure is plotted for a first pressure change event 303 and a second pressure change event 320.

The first pressure change event 303 is initiated by increasing pressure above the device from the surface of the wellbore by a specified amount. The pressure event is detected by the system at 304 when the pressure change rate dP/dT exceeds the predetermined value. The first ZRP 302 is set based on values recorded over the preceding time period 308*a*.

The pressure variation is sampled by measuring values at times 306*a* before the event, and at times 306*b* during the event 303. When the pressure has stabilised, the applied pressure 310 is calculated relative to the ZRP1 302 and is compared with upper and lower limits 312*a*, 312*b* of the opening window to see if the value 310 lies within the limits. The system monitors whether the relative pressure 310 has remained in the zone 314 for a sufficient time for the device to open. In cases where time condition is not satisfied, the pressure event is not regarded as a plug-opening or pressure equalising event and the plug is not opened. In this example, the applied pressure 310 does fall within the opening window, although not throughout full timeout period 316 as required. Thus, this event would not lead to opening of the plug.

In FIG. 5, a second pressure event 320 is identified by the system at a later time due to pressure change rate exceeding the threshold value at 322. A second ZRP (ZRP2) 324, is determined and has a value higher than ZRP1 due to, for example, increased pressure near the pressure sensor due to geological formation conditions or a change in fluid density. The setting of ZRP2 is based on pressure values 328 measured at times 306*c* over the time period 308*b*.

The same increase of wellbore pressure 310 is applied at the surface. Without appropriate adjustment to the upper and lower limits of opening window, the plug opening event would be incorrectly categorised as a pressure test. However, setting of ZRP2 and its use in subsequent calculations results in the opening zone 334 being correspondingly shifted. The event is therefore correctly identified as a plug opening event.

In other embodiments, the calculation of ZRP may use the long term trend between different ZRP calculations to determine more accurately the pressure values to which the ZRP should be set.

The present invention is particularly useful where variations in pressure at the sensor interfere with applied pressure events. These variations may be due to hydrostatic heads, changes in fluid density and the formation itself.

The automatic zeroing function of this system allows a user to confidently apply pressure above the plug in the knowledge that the equalising device will perform as required. It avoids the need to vary the pressure applied at the surface to keep the pressure in the particular range required for plug opening.

Where the equalising device has been deployed over a long period of time, the pressure felt above the device may have increased to a high value, significantly greater than that below the device. When the applied pressure required to actuate the opening of the device is added to the natural pressure value, the difference between the total above-plug pressure relative to the below-plug pressure can become large and place undue stress on the components of the device. Therefore, in an alternative embodiment, it is useful to use pressure samples measured at the second sensor S2 to calculate a zero reference pressure level. In this embodiment, it is possible to actuate the device without increasing the overall pressure differential across the device to an unacceptable. In general however, it will not be necessary to rely on measurements of the sensor S2. In other embodiments, the system may switch between using samples of the S1 and S2 sensors to determine zero reference pressure values as required.

The invention also allows historical pressure data to be uploaded from the wellbore plug after retrieval from the wellbore. In some embodiments, temperature data may also be recorded.

Various modifications and improvements may be made without departing from the scope of the invention herein intended.

The invention claimed is:

1. An electronic actuation system for a pressure equalizing device in a wellbore plug, the system including a pressure sensor for measuring pressure in the wellbore, a reference pressure value setting module which uses a measurement from the pressure sensor to set a reference pressure value, a module programmed to determine an applied pressure value using a measurement from the pressure sensor and the reference pressure value, and a module programmed to determine a rate of change in pressure measured by the pressure sensor.

2. The electronic actuation system as claimed in claim 1, further comprising a processor module for setting the reference pressure value.

3. The electronic actuation systems as claimed in claim 1, wherein the pressure sensor is arranged to measure wellbore pressure above the wellbore plug.

4. The electronic actuation system as claimed in claim 3, further comprising a second pressure sensor for measuring pressure below the plug.

5. The electronic actuating system as claimed in claim 1, further comprising a memory unit for storing measured pressure values.

6. The electronic actuation system as claimed in claim 5 wherein the processor module is programmed to compare a pressure gradient with a reference pressure value.

7. A wellbore plug incorporating the downhole apparatus as claimed in claim 1.

8. Downhole apparatus comprising: a body for locating on a work string; one or more ports provided in the body for passage of fluid between regions of the wellbore above and below the apparatus; an actuating member moveable relative to the body from a first position in which the ports are closed to prevent fluid flow therethrough, and a second position in which the ports are open to allow fluid flow therethrough, and an electronic actuating system for controlling movement of the actuating member from the first to second position; wherein the electronic actuating system includes a pressure sensor for measuring pressure in the wellbore, a reference pressure value setting module programmed to set a reference pressure value using a measurement from the'pressure sensor, a module programmed to determine an applied pressure value using a measurement from the pressure sensor and the reference pressure value; and a module programmed to determine a rate of change in pressure measured by the pressure sensor.

9. The downhole apparatus as claimed in claim 8, wherein the electronic actuation system is as claimed in claim 1.

* * * * *